US005786668A

United States Patent [19]

Lim et al.

[11] Patent Number: 5,786,668

[45] Date of Patent: Jul. 28, 1998

[54] ELECTROMAGNETIC FIELD SHIELDING CIRCUIT FOR A DISPLAY

[75] Inventors: Chai-Gwang Lim; Seung-Hwan Park, both of Suwon-si, Rep. of Korea

[73] Assignee: SamSung Electronics Co., Ltd., Suwon, Rep. of Korea

[21] Appl. No.: 739,068

[22] Filed: Oct. 28, 1996

[30] Foreign Application Priority Data

Oct. 27, 1995 [KR] Rep. of Korea ..... 37596/1995

[51] Int. Cl.[6] ..... H01J 1/52

[52] U.S. Cl. ..... 315/85; 315/8; 315/1; 315/370; 315/371

[58] Field of Search ..... 315/8, 85, 370–371, 315/408; 361/150; 313/313, 413

[56] References Cited

U.S. PATENT DOCUMENTS

| | | | |
|---|---|---|---|
| 4,644,102 | 2/1987 | Blesser et al. | 178/19 |
| 4,742,270 | 5/1988 | Fernsler et al. | 315/8 |
| 5,198,729 | 3/1993 | Powell | 315/370 |
| 5,260,626 | 11/1993 | Takase et al. | 315/85 |
| 5,285,132 | 2/1994 | Yang | 315/370 |
| 5,311,099 | 5/1994 | Grocki | 315/8 |
| 5,404,084 | 4/1995 | Onodera et al. | 315/370 |
| 5,449,975 | 9/1995 | Madsen | 315/85 |
| 5,561,133 | 10/1996 | Darius | 307/91 |
| 5,563,476 | 10/1996 | Smith et al. | 315/370 |
| 5,574,262 | 11/1996 | Petty | 178/19 |

*Primary Examiner*—Robert J. Pascal
*Assistant Examiner*—Haissa Philogene
*Attorney, Agent, or Firm*—Robert E. Bushnell, Esq.

[57] ABSTRACT

An electromagnetic field shielding circuit is disclosed. The circuit comprises a phrase inverting circuit, coupled to a turn in the secondary windings, for generating an inverted phase with respect to a phase of a voltage signal induced to the anode electrode from the secondary windings. An oscillation circuit oscillates a voltage signal output from an output node of the phase inverting circuit. The oscillating circuit matches an oscillating signal with a high voltage level signal. An electromagnetic field generation circuit applies a voltage signal output from an output mode of the oscillation circuit. This generates an electromagnetic field responsive to the voltage signal substantially around the circumferential periphery of the front portion of the picture tube. This electromagentic field cancels and shields the electromagnetic field generated from the anode.

19 Claims, 2 Drawing Sheets

ELECTROMAGNETIC FIELD SHIELDING CIRCUIT FOR A DISPLAY

CLAIM OF PRIORITY

This application makes reference to, incorporates the same herein, and claims all benefits accruing under 35 U.S.C. 119 from an application for An Electromagnetic Field Shielding Circuit For Use With A Display Apparatus earlier filed in the Korean Industrial Property Office on 27 Oct. 1995 and there duly assigned Ser. No. 37596/1995 by that Office.

FIELD OF THE INVENTION

The present invention relates in general to a device for dealing with an electromagnetic wave generated in an electric appliance and more particularly, to a device for dealing with an electromagnetic wave generated in a cathode ray tube.

BACKGROUND OF THE INVENTION

The general public began to take an increasing interest in harmful electromagnetic waves generated from an electronic and electric products such as a television receiver, personal computer and etc. Recently, this has become a center of users's interests. This interest causes manufacturers to give an Electromagnetic Influence (EMI) test on their products to make sure that their products meet the regulations thereof, as is well known in the art as an universally accepted customary practice.

An electromagnetic field generated from a cathode ray tube in a display apparatus inflicts a harmful influence upon the human body. To regulate the maximum permissible exposure to an electromagnetic wave in such a electromagnetic field, various types of organization and facilities have been active.

An European Institute known as TCO is one of the leading organizations that do tests for regulation of noxious electromagnetic waves. Among other activities, the TCO has been active in the area of regulation of the following parameters. The critical limits on these parameters are as given below.

| Parameters | Frequency Band | LIMITS | REMARK |
|---|---|---|---|
| Electric Field | ELF(5Hz~2kHz) | 10 V/M | EFL: Extremely Low |
| influence | VLF(42kHz~400kHz) | 1 V/M | Frequency |
| Magnetic Field | ELF(5Hz~2kHz) | 200 nT | VLF: Very Low |
| influence | VLF(2kHz~400kHz) | 25 nT | Frequency |

An observation on occurrence of an electromagnetic field indicates sources of production of the regulated parameters. The observation indicates that a magnetic field is produced by a voltage applied to a deflecting coil while a electric field is primarily produced by a voltage applied to an anode electrode of a cathode ray tube. Of the two, a magnetic field can be relatively easier in shielding. Compared to an electric field, a magnetic field is easier as there exist at least two ways of often effective shielding: by compensation using deflecting coil mounted on an electron gun in a cathode ray tube and by using a separate canceling coil. In contrast, an electric field produced by a voltage applied to an anode causes a difficulty in shielding or canceling the strength of the electric field.

Among contemporary practice in the art of shielding an electromagnetic field, a typical method uses a separate shielding plate provided at a front surface of a cathode ray tube. By doing so, an electromagnetic wave can be shielded in the direction of front side. As for the four side walls and rear wall of a monitor, the monitor case can shield an electromagnetic field generated by a cathode ray tube. In contrast, due to the material characteristic of glass that is used in a front surface of a cathode ray tube, a front surface is not able to shield a radiation of an electromagnetic wave from the tube unless a separate shielding plate is provided.

The method of the previous paragraph has its drawbacks. I have observed that this method that uses a separate shielding plate has, among others, the following drawbacks. First, the method requires the inconvenience of mechanically affixing a separate shielding plate to the front case section of a display apparatus, an inherently slow and complicated process. Second, the above explained inconvenience causes product efficiency to drop in a mass manufacturing of the shielding plate. This affects overall costs, thereby pushing up an unit price of a display apparatus.

An exemplar of the contemporary method recently introduced in the art to cope with the above described drawbacks employs a high voltage method. In this high voltage method, a high voltage of inverted phase with respect to an anode voltage is applied to a location substantially opposite to an anode electrode with respect to an axis of symmetry which linearly links an electron gun and a picture tube so as to cancel a voltage applied to the anode electrode. The high voltage method does not solve all problems. For example, it is known, from Powell (U.S. Pat. No. 5,198,729, *CRT Monitor with Elimination of Unwanted Time Variable Electric Field*, Mar. 30, 1993) to require a new design for a cathode ray tube which particularly provides a symmetrical location opposite to an anode electrode. This hinders the utility of existing manufacturing lines for a picture tube; some of the existing manufacturing lines may even have to be revamped. The above mentioned method has other defects. The method may require a manufacturer to undertake the inconvenience of incorporating a plurality of coating process for insulating film applied to the external surface of a picture tube. In addition, the above method is applicable only to a relatively small-sized cathode ray tube because an electromagnetic field generated by an anode voltage is to be sufficiently canceled by a phase-inverted voltage signal applied to an opposite location to the anode electrode. Another exemplar of the art is Smith et al. (U.S. Pat. No. 5,563,476, *Cathode Ray Tube Display*, Oct. 8, 1996) disclosing a cathode ray tube display having an electromagnetic deflection yoke. A pair of first deflection coils are located symmetrically about the longitudinal axis of the tube opposite sides of the yoke for producing within the tube a first magnetic deflection field. The display also includes sets of cancellation coils. Darius (U.S. Pat. No. 5,561,333, *Method and Apparatus for Reducing the Intensity of Magnetic Field Emissions from Video Display Units*, Oct. 1, 1996) discloses a method and apparatus for the reduction of the intensity of magnetic field emissions from video display units (VDU) in the vicinity of the user including a wire coil shaped to mimic the shape of conventional VDU deflection coils synchronous with the magnetic field produced by the unit's deflection coil. Madsen (U.S. Pat. No. 5,449,975, *Method and Apparatus for Reducing Electrical Alternating Fields Generated in the Surroundings of a Display Unit*, Sep. 12, 1995) discloses a method and arrangement for reducing to a minimum the electrical alternating fields generated in the surroundings of a visual display unit. The visual display unit includes a voltage connected part, on which undesirable voltage variations occur. The visual display unit also includes a compensation circuit. Yang (U.S. Pat. No. 5,285,132, *Display Device*, Feb. 8, 1994) discloses a display tube having at least one control electrode for generating an electron beam and a deflection unit for detecting the electron beam across the display screen. The deflection unit includes a line deflection coil. Based upon my study of the contemporary practice such as these exemplars, I believe that there is a need for an effective circuit that cancels electromagnetic fields produced by a cathode ray tube using an oscillating circuit as in the present invention.

SUMMARY OF THE INVENTION

Accordingly, it is an object of the present invention to provide an improved device for dealing with an electromagnetic wave generated in an electric appliance.

It is another object of the present invention to provide an improved device for dealing with an electromagnetic wave generated in a cathode ray tube.

It is another object of the present invention to provide a device for dealing with an electromagnetic wave generated in an electric appliance with a circuit operation such as clock oscillation.

It is another object of the present invention to provide an electromagnetic field shielding circuit device for use with a display apparatus having a cathode ray tube, for canceling an electromagnetic field generated in the cathode ray tube.

It is another object of the present invention to provide an improved electromagnetic field shielding circuit device.

It is another object of the present invention to provide an electromagnetic field shielding circuit for canceling or attenuating the strength of an electromagnetic field generated by a high voltage applied to an anode electrode in a display apparatus.

It is still another object of the present invention to provide an electromagnetic field shielding circuit which is applicable to a variety of types of cathode ray tube.

It is yet another object of the present invention to provide an electromagnetic field shielding circuit that is capable of meeting the standard requirements of the TCO regulation.

To achieve these and other objects, there is provided an electromagnetic field shielding circuit for use with a display apparatus having a flyback transformer. A voltage supplied to primary windings is applied to a deflecting coil. An amplified high voltage induced across secondary windings is applied to an anode electrode of a picture tube in a display.

The above circuit includes a phase inverting circuit coupled to a turn of the secondary windings for producing an inverted phase with respect to the phase of a voltage induced to the secondary windings so as to be applied to the anode electrode. An oscillation circuit takes a voltage signal output from the above phase inverting circuit so as to match the oscillated voltage signal with a voltage signal applied to the anode electrode. An electromagnetic field generating circuit cancels an electromagnetic field influencing the anode by generating another electromagnetic field extending through the circumferential surface of a front portion of a picture tube in the display.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
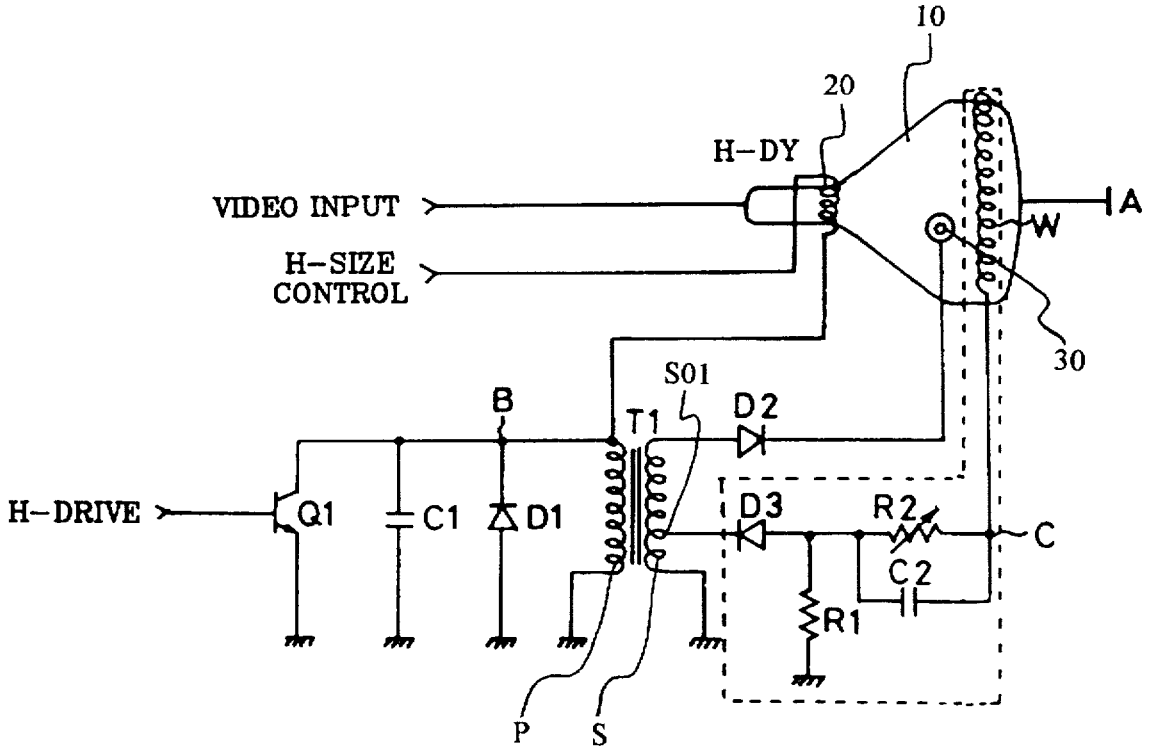
FIG. 1 is a schematic circuit diagram of an electromagnetic field elimination circuit constructed according to the principles of the present invention.

Turning now to the drawings, a detailed circuit diagram of an electromagnetic field shielding and canceling circuit according to an embodiment of the present invention is shown in FIG. 1. The circuit illustration in FIG. 1 includes a flyback transformer T1 or a drive transformer for deflection which applies a voltage supplied to a primary windings thereof to a deflecting coil. As is shown in FIG. 1, a circuit coupled to the primary windings has a transistor Q1, a capacitor C1, and a first diode D1. The primary windings P, the transistor Q1, the capacitor C1, and the first diode D1 are joined at a point B. The primary windings P, the transistor Q1, the capacitor C1, and the first diode D1 are each joined to reference voltages. As for secondary windings S of the transformer, a second diode D2 receives a voltage signal input at its anode lead induced across at an arm of the secondary windings S. The second diode D2 rectifies in forward direction, and outputs a rectified voltage signal at its cathode lead. The second diode D2 is connected to acceleration voltage contact 30. A third diode D3 is coupled in reverse direction to another arm S01 of the secondary windings S. The third diode D3 receives a voltage induced at the another arm at its cathode load, rectifies in reverse direction, and outputs a rectified voltage at its anode lead. A first resistor R1 is connected between the anode lead of third diode D3 and a reference voltage. A capacitor C2 is charged by a voltage induced at a junction node between third diode D3 and first resistor R1. A second resistor R2, along with the first resistor R1, provides an electrical conduction path to a reference voltage during a discharging operation of capacitor C2. The second resistor R2 can be a variable resistor. A wire W stabilizes and provides an electrical conduction path for a voltage signal being oscillated by a coupling of capacitor C2 and second resistor R2. The wire is disposed to extend through the four corners of a front portion of a picture tube 10.

The various components and circuits coupled to the primary windings P of a flyback transformer T1 will be omitted for the sake of brevity in explanation. FIG. 1, in conjunction with other parts of the specification and the figures, clearly suggests the various components and circuits. Now, by way of a non-limiting example, an operation of a preferred embodiment of the present invention will be described in greater detail in conjunction with drawings.

A separate magnetic field induction cable other than a high voltage induction cable connected to an anode lead from an arm of secondary windings S of flyback transformer T1, is used to obtain a pulse signal. That is, a switching pulse of inverted phase with respect to that applied to the high voltage induction cable is available at a junction node between third diode D3 and first resistor R1. A train of switching pulses as explained above is attainable by forming a waveform of inverted phase and of opposite in shape with respect to a pulse applied to a collector electrode of a transistor Q1. The switching pulse is obtained by providing a magnetic field induction cable in a reverse direction to a magnetic field induction cable connected to an arm of the primary windings P of a flyback transformer T1.

Figure 2:
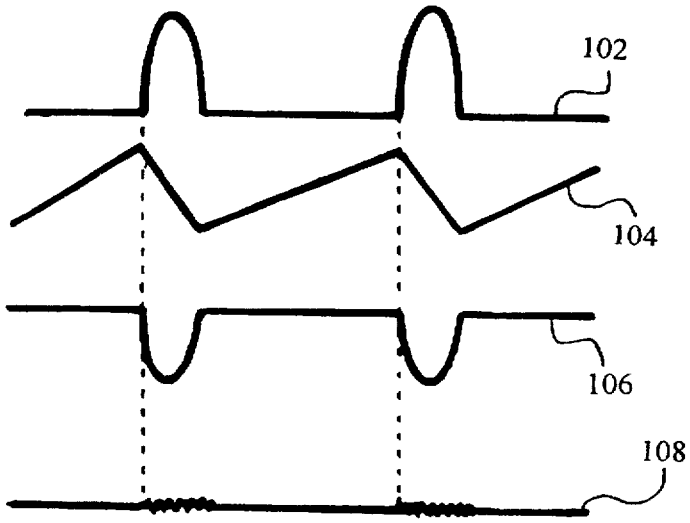
FIG. 2 illustrates various exemplars of waveforms taken at some points of the circuit in FIG. 1.

Referring to FIG. 2, the wave forms 102 and 106 illustrate the operation of the above described circuit. A wave form 102 illustrates voltage level at point B. The point B is a junction node that can be a source of electromagnetic field generation. The waveform 104 illustrates its current flow. The waveform 106 illustrates a voltage waveform of cancellation pulse to be applied to the circumferential periphery of the front portion of a picture tube 10.

As a result, an electromagnetic field induced at point A, before application of an induced canceling signal, has a voltage waveform that is approximately similar to a voltage waveform applied at point B. Point A is the point of measurement of electromagnetic field that is located away from the front surface of a picture tube by 30 cm to 50 cm. Accordingly, an electromagnetic field can be canceled by inducing a voltage of inverted phase with respect to a voltage applied at point B. This voltage of inverted phase is applied to the junction node C. The induced voltage is applied to the circumstantial periphery of the front portion of the picture tube. On this occasion of cancellation, the wave form 108 illustrates a voltage waveform at point A, which is a measuring point.

Having the goal of obtaining the ideal pulse of "0 Vpp" (zero voltage) applied at point A by phase matching between the two pulses induced at points B and C, a pulse for canceling an electromagnetic field is generated from the secondary windings S of flyback transformer T1. To obtain an effective cancellation pulse, the ratio between the pair of resistors R1, R2 is adjustable in dependance upon either the volume of a picture tube (which can be a cathode ray tube) or the strength of a source voltage applied to the tube or other factors. Further, the number of turns of windings in a flyback transformer may be adjustable in dependance upon either the volume of a picture tube (which can be a cathode ray tube) or the strength of a source voltage applied to the tube or other factors. Thus, a cancellation pulse of several hundreds Vpp or even more potential level is attainable. Additionally, a capacitor C2 is employed to properly adjust a phase shift of the cancellation pulse when it is out of phase with the source pulse.

Figure 3:
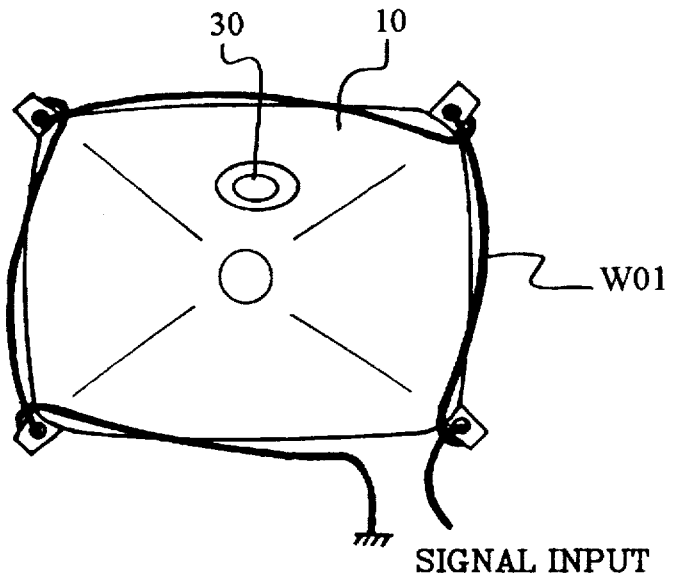
FIG. 3 is an exemplar an embodiment built according to the principles of the present invention, in which a wire is installed to extend through each of the brackets mounted on the four corners of a picture tube, so as to apply a pulse generated to cancel an electromagnetic field.

Now, moving on to FIG. 3, a wire W01 is installed on the lugs of each corner of a substantially rectangular front portion of a picture tube. The wire W01 is extended through holes of each bracket mounted on four corners of a picture tube provided to support and fix the tube, so as to affix wire W01 to the tube. Thus the wire W01 surrounding the circumferential periphery of the front portion of a picture tube receives a pulse signal. This pulse signal is of inverted phase with respect to that applied to an anode and thereby produces a cancelling electromagnetic field. This produced cancelling electromagnetic field cancels an electromagnetic field generated from an anode in the picture tube. This attenuates the strength of the electromagnetic field that had been induced to certain location on the front surface of the picture tube.

Figure 4:
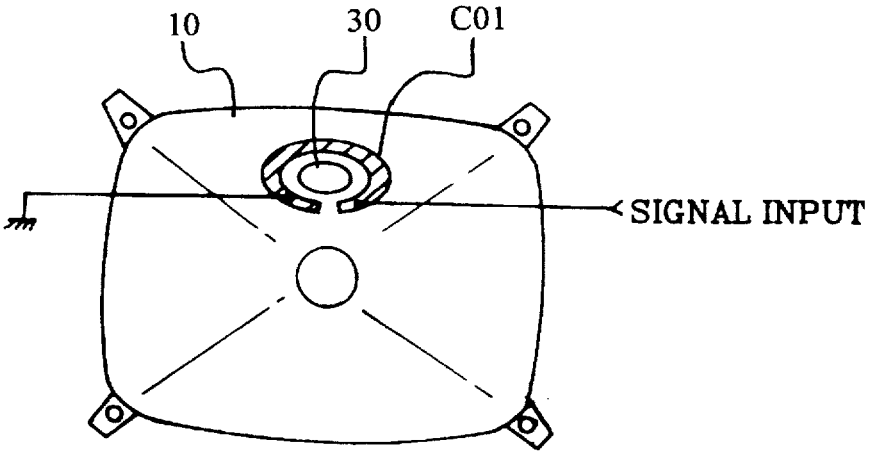
FIG. 4 is an exemplar of another preferred embodiment built according to the principles of the present invention, in which a copper plate is used in cancellation of an electromagnetic field.

In FIG. 4, another preferred embodiment of the present invention is illustrated. A copper plate C01 is affixed to a location substantially adjacent to a cap of an anode electrode of a picture tube. An input lead is connected to receive a cancellation signal applied from a junction node C and an output lead is grounded. By disposing the copper plate C01 as above, a harmful electromagnetic field radiated from an anode electrode is offset at an adjacent location.

Upon application of the present invention, it is noted that a laboratory work discovered that the strength of electromagnetic field measure at a location adjacent to point A is lessened by at least 60% compared to its source. In a measurement of using a contemporary display apparatus, a measurement at point A was originally (without an application of the present invention) approximately 1.8 V/M in its strength. By application of the present invention, it was lessened to approximately 0.8 V/M.

As explained above, a preferred embodiment according to the present invention is able to suppress or shield an electromagnetic field produced during an operation by a high voltage applied to an anode of a picture tube in a display apparatus, thereby enhancing manufacturing efficiency, at a low cost. Another advantageous result of the present invention can be that the circuit of the present invention is able to be employed in a cathode ray tube of a variety of ranges of sizes, thereby enhancing manufacturing efficiency, at a low cost.

While there have been illustrated and described what are considered to be embodiments of the present invention, it will be understood by those skilled in the art that various changes and modifications may be make, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments failing within the scope of the appended claims.

What is claimed is:

1. A display apparatus having a flyback transformer for supplying a high voltage to an anode of a picture tube, said high voltage induced at secondary windings of the flyback transformer, and a circuit disposed to shield an electromagnetic field radiated from said anode of said picture tube, said circuit comprising:

a phase inverting circuit coupled to a turn in said secondary windings, disposed to generate a voltage output having a phase inverted with respect to a phase of said high voltage applied to said anode of said picture tube from said secondary windings, said phase inverting circuit having a diode disposed to connect in a reverse direction to a turn of said secondary windings and having a first resistor coupled between a data input terminal of said diode and a reference voltage terminal;

an oscillation circuit disposed to generate an oscillating voltage signal by oscillating said voltage output from said phase inverting circuit, said oscillating circuit disposed to match said oscillating voltage signal with said high voltage applied to said anode of said picture tube, said oscillating circuit comprising;

a capacitor disposed to charge and discharge said voltage signal output from said phase inverting circuit, said capacitor being charged by a voltage induced across said first resistor coupled to said diode, and a second resistor disposed to establish an electrical conduction path during a discharging operation of said capacitor, to adjust an oscillating period and vary a discharging time of said capacitor, and to discharge said capacitor to said reference voltage terminal via said first resistor; and an electromagnetic field generation circuit disposed to induce an electromagnetic field in dependence upon said oscillating voltage signal from said oscillation circuit so as to cancel and shield said electromagnetic field radiated from said anode of said picture tube.

2. The display apparatus of claim 1, wherein said electromagnetic field generation circuit comprises:

a copper plate fixed adjacent to said anode of said picture tube, and having an input terminal coupled to receive said oscillating voltage signal from said oscillation circuit and an output terminal connected to a ground potential.

3. The display apparatus of claim 1, wherein said electromagnetic field generation circuit comprises:

a wire coil disposed to encompass sidewalls of a front portion of said picture tube, to radiate an electromagnetic field in dependence upon said oscillating voltage signal from said oscillation circuit, to offset said electromagnetic field radiated from said anode of said picture tube, said wire coil extending through each one of brackets disposed at four corners of said picture tube, said wire coil having an input lead coupled to receive said oscillating voltage signal from said oscillation circuit and an output lead connected to said reference voltage terminal.

4. A display apparatus having a transformer for supplying a high voltage to an anode of a picture tube, and a circuit disposed to shield an electromagnetic field radiated from said anode of said picture tube, said circuit comprising:

a phase inverting circuit coupled to a turn in said secondary windings, and disposed to generate a voltage output having a phase inverted with respect to a phase of a voltage signal applied to said anode of said picture tube from said secondary windings, said phase inverting circuit comprising a diode connected in a reverse direction to a turn of said secondary windings, and a first resistor connected between a data input terminal of said diode and a reference voltage terminal;

an oscillation circuit disposed to generate an oscillating voltage signal by oscillating said voltage output from said phase inverting circuit, and to match said oscillating voltage signal with said high voltage signal applied to said anode of said picture tube; and an electromagnetic field generation circuit disposed to induce an electromagnetic field in dependence upon said oscillating voltage signal from said oscillation circuit so as to cancel and shield said electromagnetic field radiated from said anode of said picture tube.

5. The display apparatus of claim 4, wherein said oscillation circuit comprises:

a capacitor disposed to charge and discharge said voltage signal output from said phase inverting circuit, said capacitor being charged by a voltage induced across said first resistor coupled to said diode; and a second resistor disposed to establish an electrical conduction path during a discharging operation of said capacitor, to adjust an oscillating period and vary a discharging time of said capacitor, and to discharge said capacitor to said reference voltage terminal via said first resistor.

6. The display apparatus of claim 4, wherein said electromagnetic field generation circuit comprises:

a copper plate fixed to a location adjacent to said anode of said picture tube, said copper plate having an input terminal supplied with said oscillating voltage signal from said oscillation circuit and an output terminal connected to a ground potential.

7. The display apparatus of claim 4, wherein said electromagnetic field generation circuit comprises:

a wire coil disposed to encompass sidewalls of a front portion of said picture tube, to radiate an electromagnetic field in dependence upon said oscillating voltage signal from said oscillation circuit, to offset said electromagnetic field radiated from said anode of said picture tube, said wire coil extending through each one of brackets disposed at four corners of said picture tube, said wire coil having an input lead coupled to receive said oscillating voltage signal from said oscillation circuit, and an output lead connected to said reference voltage terminal.

8. The display apparatus of claim 7, wherein said oscillation circuit comprises:

a capacitor disposed to charge and discharge said voltage signal output from said phase inverting circuit; and a second resistor disposed to establish an electrical conduction path during a discharging operation of said capacitor.

9. The display apparatus of claim 6, wherein said oscillation circuit comprises a capacitor being charged by a voltage induced across said first resistor coupled to said diode; and a second resistor having a variable resistor disposed to adjust an oscillating period and vary a discharging time of said capacitor, said second resistor disposed to discharge said capacitor to said reference voltage terminal via said first resistor.

10. The display apparatus of claim 8, wherein said second resistor comprises a variable resistor disposed to adjust an oscillating period and vary a discharging time of said capacitor.

11. The display apparatus of claim 4, further comprised of said oscillation circuit matching said oscillating voltage signal with said high voltage applied to said anode of said picture tube in amplitude.

12. The display apparatus of claim 4, wherein said picture tube is a cathode ray tube.

13. The display apparatus of claim 4, wherein said electromagnetic field generation circuit comprises:

a wire coil disposed to encompass sidewalls of a front portion of said picture tube, to radiate an electromagnetic field in dependence upon said oscillating voltage signal from said oscillation circuit, and to offset said electromagnetic field radiated from said anode of said picture tube.

14. The display apparatus of claim 13, wherein said wire coil extends through each one of brackets disposed at four corners of said picture tube.

15. The display apparatus of claim 13, wherein said wire coil comprises:

an input lead coupled to receive said oscillating voltage signal from said oscillation circuit; and an output lead connected to said reference voltage terminal.

16. An apparatus for suppressing electromagnetic field radiated from a display device, comprising:

a high voltage generation circuit for applying a high voltage signal to an anode of said display device;

a wire coil arranged to enclose a front surface of said display device; and an electromagnetic field suppression circuit for applying an electromagnetic field suppression signal to said wire coil with a polarity opposite to said high voltage signal applied to said anode of said display device for suppression of said electromagnetic field radiated from the front surface of said display device, said electromagnetic field suppression circuit comprising:

a phase inverter comprising a diode and a resistor, connected to said high voltage generation circuit for inverting the polarity of said high voltage signal applied to said anode of said display device to produce said electromagnetic field suppression signal; and a phase adjuster connected to said phase inverter, for adjusting phase shift of said electromagnetic field suppression signal before application to said wire coil for suppression of said electromagnetic field radiated from the front surface of said display device.

17. The apparatus of claim 16, wherein said phase adjuster comprises a capacitor disposed to charge and discharge said electromagnetic field suppression signal from said phase inverter, and a variable resistor disposed to establish an electrical conduction path during a discharging operation of said capacitor.

18. An apparatus for suppressing electromagnetic field radiated from a display device, comprising:

a high voltage generation circuit for applying a high voltage signal to an anode of said display device;

a copper plate disposed adjacent to, and arranged to substantially enclose said anode of said display device; and an electromagnetic field suppression circuit for applying an electromagnetic field suppression signal to said copper plate with a polarity opposite to said high voltage signal applied to said anode of said display device for suppression of said electromagnetic field radiated from said display device, said electromagnetic field suppression circuit comprising:

a phase inverter comprising a diode and a resistor, connected to said high voltage generation circuit for inverting the polarity of said high voltage signal applied to said anode of said display device to produce said electromagnetic field suppression signal; and a phase adjuster connected to said phase inverter, for adjusting phase shift of said electromagnetic field suppression signal before application to said copper plate for suppression of said electromagnetic field radiated from said display device.

19. The apparatus of claim 18, wherein said phase adjuster comprises a capacitor disposed to charge and discharge said electromagnetic field suppression signal from said phase inverter, and a variable resistor disposed to establish an electrical conduction path during a discharging operation of said capacitor.

* * * * *